United States Patent [19]

McDonald et al.

[11] Patent Number: 4,694,913

[45] Date of Patent: Sep. 22, 1987

[54] GUIDED EARTH BORING TOOL

[75] Inventors: William J. McDonald; Gerard T. Pittard; William C. Maurer; Michael R. Wasson; William C. Herben, all of Houston, Tex.

[73] Assignee: Gas Research Institute, Chicago, Ill.

[21] Appl. No.: 863,957

[22] Filed: May 16, 1986

[51] Int. Cl.[4] ..... E21B 4/14; E21B 4/20; E21B 7/08

[52] U.S. Cl. ..... 175/61; 175/19

[58] Field of Search ..... 175/61, 62, 19-22

[56] References Cited

U.S. PATENT DOCUMENTS

| | | | |
|---|---|---|---|
| 1,894,446 | 1/1933 | McKenny | 175/22 |
| 2,181,284 | 11/1939 | Potts | 175/61 |
| 2,517,494 | 8/1950 | Kiss et al. | 175/22 |
| 3,905,431 | 9/1975 | Hasewend | 175/62 X |
| 4,117,895 | 10/1978 | Ward et al. | 175/62 X |
| 4,135,588 | 1/1979 | Wagner | 175/62 X |
| 4,144,941 | 5/1979 | Ritter | 175/19 |

FOREIGN PATENT DOCUMENTS

| | | | |
|---|---|---|---|
| 0156784 | 5/1978 | Netherlands | 175/19 |

*Primary Examiner*—Stephen J. Novosad
*Assistant Examiner*—Thuy M. Bui
*Attorney, Agent, or Firm*—Neal J. Mosely

[57] ABSTRACT

Long utility holes, for gas lines, electrical conduit, communications conduit and the like, may be bored or pierced horizontally through the earth, particularly under obstacles, such as buildings, streets, highways, rivers, lakes, etc. Such holes may be bored by an underground drilling mole (underground percussion drill) supported on a hollow drill rod and supplied with compressed air through the rod to operate an air hammer which strikes an anvil having an external boring face, preferably constructed to apply an asymmetric boring force. The drill rod is operated by a drill rig on the surface or recessed in special pit for horizontal drilling and provides for addition of sections of pipe or hollow rod as the boring progresses. The asymmetric boring force causes the boring path to curve and, when straight line drilling is needed, the drill rod is rotated to counteract the asymmetric boring force. An alternative boring tool utilizes an expander supported on a solid or hollow drill rod and having a base end supported on and larger in diameter than the rod and tapering longitudinally forward therefrom. It may have a uniform extension protruding a short distance forward. The tool penetrates the earth upon longitudinal movement of the drill rod.

26 Claims, 16 Drawing Figures

GUIDED EARTH BORING TOOL

BACKGROUND OF THE INVENTION

1. Field of the Invention

This invention relates to new and useful improvements in earth boring tools and more particularly to improved tools for boring more or less horizontally through the earth for laying utility lines, such as gas lines, electrical or communications conduit, etc.

2. Brief Description of the Prior Art

Utility Companies often find it necessary to install or replace piping beneath different types of surfaces such as streets, driveways, railroad tracks, etc. To reduce costs and public inconvenience by eliminating unnecessary excavation and restoration, utilities sometimes use underground boring tools to install the new or replacement pipes. Existing boring tools are suitable for boring short distances (up to 60 ft.), but are not sufficiently advanced to provide directional control for longer distances. This lack of control, coupled with the inability of these tools to detect and steer around obstacles, has limited their use to about 20% of all excavations, with the majority of the remaining excavations being performed by open-cut cut trenching methods.

Therefore, the development of an economic, guided, horizontal boring tool would be useful to the utility industry, since it would significantly increase the use of boring tools by removing the limitations of poor accuracy and by reducing the occurrence of damage to in-place utilities. Use of such a tool instead of open-cut methods, particularly in developed areas, should result in the savings of millions of dollars annually in repair, landscape restoration and road resurfacing costs.

Conventional pneumatic and hydraulic percussion moles are designed to pierce and compact compressible soils for the installation of underground utilities without the necessity of digging large launching and retrieval pits, open cutting of pavement or reclamation of large areas of land. An internal striker or hammer reciprocates under the action of compressed air or hydraulic fluid to deliver high energy blows to the inner face of the body. These blows propel the tool through the soil to form an earthen casing within the soil that remains open to allow laying of cable or conduit.

From early 1970 to 1972, Bell Laboratories, in Chester, N.J., conducted research aimed at developing a method of steering and tracking moles. A 4-inch Schramm Pneumagopher was fitted with two steering fins and three mutually orthogonal coils which were used in conjunction with a surface antenna to track the position of the tool. One of these fins was fixed and inclined from the tool's longitudinal axis while the other fin was rotatable.

Two boring modes could be obtained with this system by changing the position of the rotatable fin relative to the fixed fin. These were (1) a roll mode in which the mole was caused to rotate about its longitudinal centerline as it advanced into the soil and (2) a steering mode in which the mole was directed to bore in a curved path.

The roll mode was used for both straight boring and as a means for selectively positioning the angular orientation of the fins for subsequent changes in the bore path. Rotation of the mole was induced by bringing the rotatable fin into an anti-parallel alignment with the fixed fin. This positioning results in the generation of a force couple which initiates and maintains rotation.

The steering mode was actuated by locating the rotatable fin parallel to the fixed fin. As the mole penetrates the soil, the outer surfaces of the oncoming fins are brought into contact with the soil and a "slipping wedge" mechanism created. This motion caused the mole to veer in the same direction as the fins point when viewed from the back of the tool.

Published information on the actual field performance of the prototype appears limited to a presentation by J. T. Sibilia of Bell Laboratories to the Edison Electric Institute in Cleveland, Oh. on Oct. 13, 1972. Sibilia reported that the system was capable of turning the mole at rates of 1° to 1.5° per foot of travel. However, the prototype was never commercialized.

Several percussion mole steering systems are revealed in the prior art. Coyne et al, U.S. Pat. No. 3,525,405 discloses a steering system which uses a beveled planar anvil that can be continuously rotated or rigidly locked into a given steering orientation through a clutch assembly. Chepurnoi et al, U.S. Pat. No. 3,952,813 discloses an off-axis or eccentric hammer steering system in which the striking position of the hammer is controlled by a transmission and motor assembly. Gagen et al, U.S. Pat. No. 3,794,128 discloses a steering system employing one fixed and one rotatable tail fin.

However, in spite of these and other prior art systems, the practical realization of a technically and cost-effective steering system has been elusive because the prior systems require complex parts and extensive modifications to existing boring tools, or their steering response has been far too slow to avoid obstacles or significantly change the direction of the boring path within the borehole lengths typically used.

In commonly assigned U.S. patent application Ser. No. 720,582, now U.S. Pat. No. 4,632,191. A steering system is disclosed for percussion boring tools for boring in the earth at an angle or in a generally horizontal direction. The steering mechanism comprises a slanted-face nose member attached to the anvil of the tool to produce a turning force on the tool and movable tail fins incorporated into the trailing end of the tool which are adapted to be selectively positioned relative to the body of the tool to negate the turning force. Turning force may also be imparted to the tool by an eccentric hammer which delivers an off-axis impact to the tool anvil.

The fins are constructed to assume a neutral position relative to the housing of the tool when the tool is allowed to turn and to assume a spin inducing position relative to the housing of the tool to cause it to rotate when the tool is to move in a straight direction.

For straight boring, the tail fins are fixed to induce spin of the tool about its longitudinal axis to compensate for the turning effect of the slanted nose member or eccentric hammer. When the fins are in the neutral position, the slanted nose member or the eccentric hammer will deflect the tool in a given direction. The fins also allow the nose piece to be oriented in any given plane for subsequent steering operation.

The apparatus disclosed in our co-pending patent application has the limitation that it is possible for the tool to be disabled in the bore hole and require excavation to recover the drilling mole. There has been some need therefore for a tool which can be operated from a rigid support which permits positive movement of the tool both into and out of the bore hole which would allow the tool to be pulled out by the means used to power it, e.g. an external drilling rig.

The rigid support offers other advantages including (a) providing a conduit to install and/or remove instrumentation, (b) providing a strong member to back-ream or enlarge the hole, (c) providing a tensile member to pull or push utility pipe into the hole, etc.

SUMMARY OF THE INVENTION

One object of this invention to provide a cost-effective guided horizontal boring tool which can be used to produce small diameter boreholes into which utilities, e.g., electric or telephone lines, TV cable, gas distribution piping, or the like, can be installed.

Another object of the invention is to provide a steering system that offers a repeatable and useful steering response in boreholes which is compatible with existing boring equipment and methods and requires only minimal modification of existing boring tools.

Another object of this invention is to provide a steering system which will enable a horizontal boring tool to travel over great distances and reliably hit a small target.

Another object of this invention is to provide boring tool which will produce a guided borehole to avoid obstacles and to correct for deviations from the planned boring path.

Another object of this invention is to provide a boring tool immune to adverse environmental conditions and which allows the boring operation to be conducted by typical field service crews.

A further object of this invention is to provide a guided horizontal boring tool which requires a minimal amount of excavation for launching and retrieval and thereby reducing the disturbance of trees, shrubs or environmentally sensitive ecosystems.

A further object of this invention is to provide a guided horizontal boring tool which is operated from a rigid external operating member and driven by an external power source.

A still further object of this invention is to provide a guided horizontal boring tool which is supported on a drill rod or pipe and operated by a drill rig either from a launching pit or from the surface.

A still further object of this invention is to provide a guided horizontal boring tool operated from a rigid external operating member and driven by an external power source and controlled for direction of movement from outside the borehole.

A still further object of this invention is to provide a guided horizontal boring tool operated from a rigid external operating member and driven by an external power source and includes an expander boring element driven into the earth by non-rotative movement.

Other objects of the invention will become apparent from time to time throughout the specification and claims as hereinafter related.

A guided horizontal boring tool constructed in accordance with the present invention will benefit utilities and rate payers by significantly reducing installation and maintenance costs of underground utilities by reducing the use of expensive, open-cut trenching methods. Long utility holes, for gas lines, electrical or communications conduit and the like, may be bored or pierced horizontally through the earth, particularly under obstacles, such as buildings, rivers, lakes, etc.

Such holes may be bored by an underground drilling mole (undergroud percussion drill) supported on a hollow drill rod and supplied with compressed air through the rod to operate an air hammer which strikes an anvil having an external boring face, preferably constructed to apply an asymmetric boring force, e.g., by (a) a bent sub for a hammer, (b) a deflection pad on a hammer, (c) an asymmetric hammer or (d) a boring member having an inclined plane on the piercing or boring face.

The drill rod is operated by a drill rig on the surface or recessed in special pit for horizontal drilling and provides for addition of sections of pipe or hollow rod as the boring progresses. The asymmetric boring force causes the boring path to curve and, when straight line drilling is needed, the drill rod is rotated to counteract the asymmetric boring force. An alternative boring tool utilizes an expander supported on a solid or hollow drill rod and having a base end supported on and larger in diameter than the rod and tapering longitudinally forward therefrom to an extension extending a short distance forward. The tool penetrates the earth upon longitudinal movement of the drill rod.

DESCRIPTION OF A PREFERRED EMBODIMENT

Figure 1:
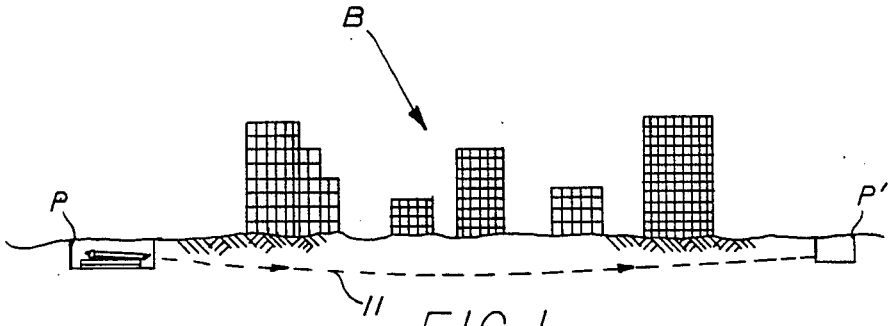
FIG. 1 is a schematic drawing, partially in section, showing horizontal boring from a recessed pit containing a drilling rig.
Figure 2:
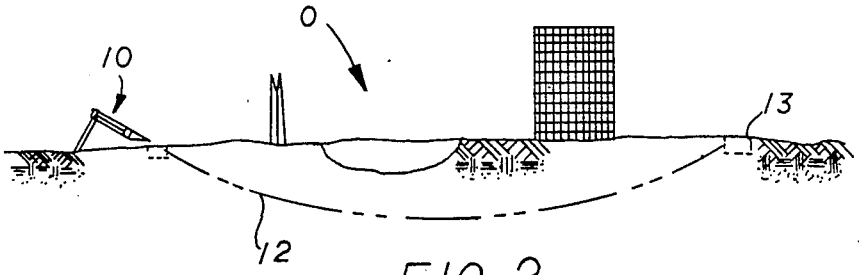
FIG. 2 is a schematic drawing, partially in section, showing horizontal boring from a drilling rig on the surface.

Referring to the drawings, by numerals of reference, and more particularly to FIGS. 1 and 2, there are shown schematic views, in vertical section, of two versions of the horizontal boring of long utility holes according to this invention. The experimental work done in the development of this invention has shown that it is feasible to bore long horizontal utility holes, from 200–2,000 feet, more economically than trenching or augering.

Two systems for boring long horizontal utility holes are illustrated in FIGS. 1 and 2.

In FIG. 1, there is shown a schematic view of long horizontal boring starting from a launching pit. In FIG. 1, there is shown a launching pit P in which there is positioned a drilling rig and boring apparatus generally designated 10 for boring a horizontal hole along the drill line 11 to an exit pit P'. The bore hole 11 is shown extending beneath a plurality of buildings B.

In FIG. 2 there is shown an alternate version of horizontal boring which uses a slant drilling technique. In FIG. 2, the drill rig 10 is mounted at about a 30 degree angle to the earth so that the boring enters the earth at a 30' angle and continues along an arcuate path 12 where it exits from the earth at an exit point 13 beyond the obstacles under which the hole has been drilled.

In FIG. 2, the bore hole 12 passes beneath a variety of obstacles generally designated O, including for example, a windmill, a lake or river and a building. In both versions, the utility pipe or conduit laid in the holes which are bored will connect to trenches for continuing the utility lines beyond the obstacles where trenching may be the more economical way to lay pipe or conduit.

Horizontal holes, including both the straight horizontal holes and the slant or arcuate holes have the advantages that the holes require less direction change and are closer to the surface in case the pipe or the downhole motor have to be dug up. The straight horizontal holes, however, have the disadvantage that a pit has to be dug to hold the boring machine and the work area may be limited. The slant holes extend in a generally horizontal direction along an arcuate path but may give rise to problems in the event that the downhole motor is disabled.

Both the slant boring and the straight horizontal boring are good methods for rapid and inexpensive implacement of utility lines. Slant holes are best suited for boring long utility holes, e.g. 500 to 2,000 feet, where larger rigs are required. Straight horizontal boring is best for shorter holes, e.g. 200 to 500 feet, which require small drill rigs and where slant holes would require rapid angle change in order to maintain a shallow corridor or to hit a small target. Both drilling techniques have been demonstrated in extensive field tests of the apparatus which was developed in accordance with this invention.

In FIGS. 3, 5, 7, 8 and 13 there are shown various aspects of the invention utilizing a drilling mole supported on a hollow drill rod or pipe for a horizontal boring operation.

Figure 3:
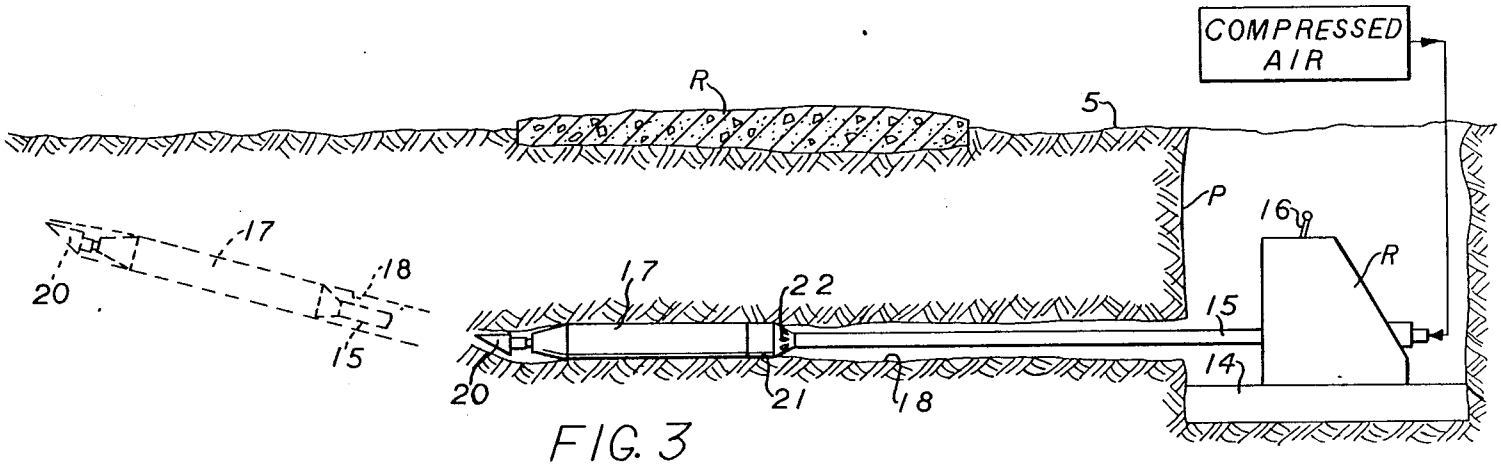
FIG. 3 is a schematic drawing, partially in section, showing horizontal boring from a recessed pit containing a drilling rig, using a drilling mole mounted on a hollow drill rod or pipe driven by the rig..

In FIG. 3, there is shown a launching kit P recessed from the surface S of the earth on one side of an obstacle such as a road bed R under which the utility hole is to be bored. A drill rig R is shown schematically in the launching pit P supported on tracks 14. The rig R is of a construction similar to vertically operated drilling rigs but utilizes movement along the tracks 14 to provide the drilling thrust.

Drilling rig R is operable to support and move sections of drill rod 15 and permits the addition of additional sections of rod as the drilling progresses through the earth. The drilling rig R is provided with conventional controls illustrated by control handle 16 on the drill console. Drill rod 15 supports a drilling mole 17 at its end for drilling a horizontal hole 18 through the earth. Drilling mole 17 is a pneumatically operated drilling mole and may have the structure shown in copending U.S. patent application Ser. No. 720,582.

Drill rod 15 is hollow and connected to the source 19 of compressed air. Compressed air from compressed air source 19 is supplied through hollow drill rod 15 to pneumatic mole 17 which operates a hammer (not shown) which pounds on an anvil member connected to an external boring element 20.

Drilling mole 17 has a connection sub 21 connecting the mole to the hollow drill rod or pipe 15. Connection sub 21 is shown in detail in FIG. 13 and has a plurality of holes or openings 22 for exhausting air from mole 17 back into the bore hole 18 behind the mole.

As will be described hereafter, boring mole 17 operates through boring element 20 to punch or pierce a hole through the earth. This mechanism of boring avoids the formation of cuttings or spoils which must be removed from the bore hole. The mole 17 operates strictly by a percussive boring or piercing and not by any rotary boring movement.

The angled cutting face on boring element 20 causes the boring mole to deviate from a straight path and to follow a continually curving path. This permits the use of a tool for drilling slant holes along an arcuate path as shown in FIG. 2. It also permits the tool to be used where a straight hole needs to be drilled and at some point into the hole the mole is allowed to deviate along a selected curved path to emerge from underground through the surface of the earth.

The drilling rig R has a mechanism for not only advancing the supporting pipe 15 and drilling mole 17 but also to rotate the pipe and drilling mole. If the drilling rig R causes pipe 15 and drilling mole 17 to rotate the angled boring surface 45 of boring element 20 is rotated and the tool is allowed to move in a straight line. Actually the tool does not move in a perfectly straight line but rather in a very tight spiral which is substantially a straight line.

The arrangement for providing an asymmetric boring force shown in FIG. 3 may be replaced by an asymmetric hammer in the boring tool as shown in pending application Ser. No. 720,582. Now U.S. Pat. No. 4,632,191. The details of the asymmetric hammer do not form a part of this invention but merely illustrate another means for applying an asymmetric boring force in the apparatus and method of this invention which involves drilling either straight horizontal bore holes or arcuate bore holes using a drilling mole supported on a hollow pipe or drill rod moved by a drill rig.

Other known means for deflecting a drill bit or other earth boring member may be used, such as deflection pads on an in-hole hammer, or a bent sub supporting a in-hole hammer. Also, in cases where straight hole drilling is not required, i.e., where it is desired only to drill in a curved boring path, the means for rotating the hammer or the boring or piercing member may be omitted.

Figure 5:
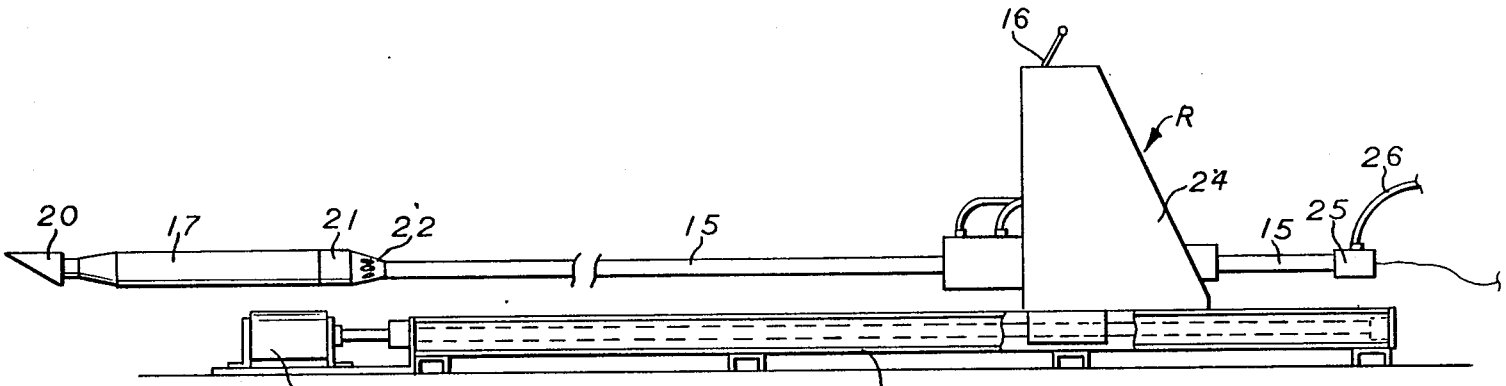
FIG. 5 is a more detailed schematic of the drill rig and drilling mole shown in FIG. 3.

In FIG. 5 there is shown some additional details of this earth boring method and apparatus. In this view it is seen that drill rig R is mounted on track 14 and is provided with a motor 23 for advancing the console 24 of the rig along the track and also for providing the means for rotating the hollow drill rod or pipe 15. Console 24 has control handle 16 which determine the advance of the console along track 14 and also may selectively rotate the drill rod 15 or permit the drill rod to remain in a non-rotating position.

The drill rig R utilizes conventional features of drill rig design for surface rigs which permits the addition of successive sections on drill rod or pipe 15 as the drill mole 17 is moved through the earth. In FIG. 5, the connection 25 is shown on the rear end of drill pipe 15 with conduit or piping 26 extending to the source 19 of compressed air.

Figure 13:
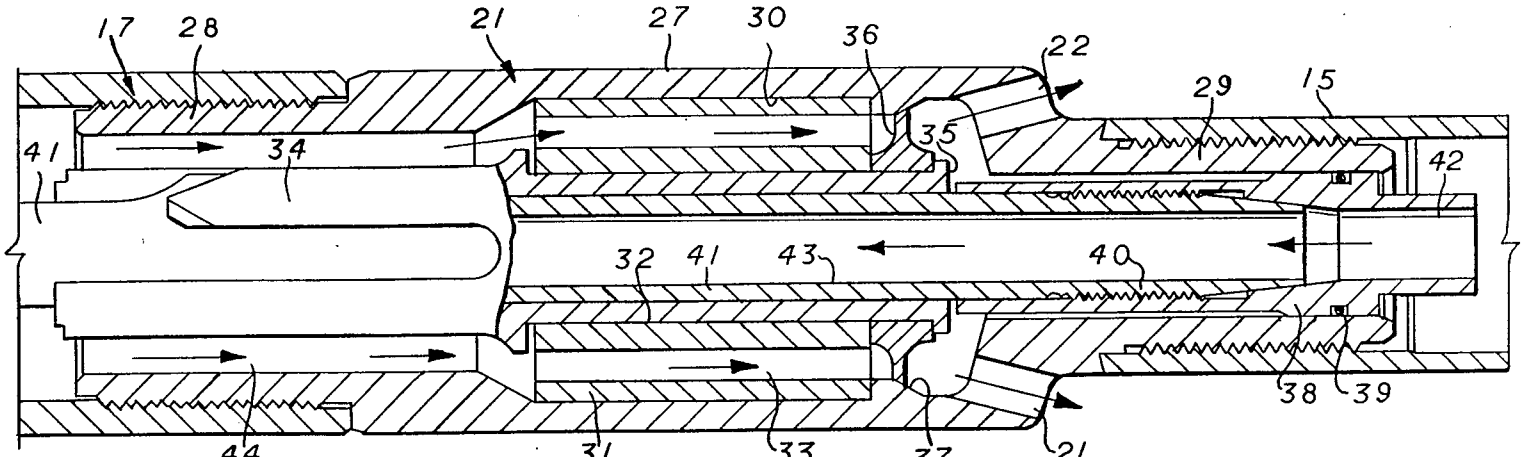
FIG. 13 is a sectional view of the connection sub for mounting the boring mole on the hollow drill rod to provide for exhausting air from the mole.

In FIG. 13 there is shown details of the connecting sub 21 which connects the housing of drilling mole 17 to the hollow drill rod or pipe 15. Connecting sub 21 comprises a main tubular body portion 27 having smaller tubular extensions 28 and 29 at opposite ends. Extensions 28 and 29 fit respectively into the open rear end of the housing of drilling mole 17 and the forward end of drill pipe 15.

The main body portion 17 has an enlarged bore 30 which receives a cylindrical supporting member 31 having a central bore 32 and a plurality of air passages 33. Supporting member 31 supports tubular member 34 in the central bore 32. Tubular member 34 terminates in a flanged end portion 35 which supports an annular check valve 36 which is normally closed against a valve surface 37. Another tubular member 38 is supported in tubular extension 29 and sealed against leakage of air pressure by O-ring 39.

Tubular member 38 receives the reduced diameter end portion 40 of a tubular member 41 which extends into the housing of mole 17 for conducting air into the mole for operating the hammer. This connection sub conducts compressed air from drill rod or pipe 15 through the inlet 42 to tubular member 38 and through the hollow bore 43 of tubular member 41 into the drill motor for operating the hammer which provides a percussive force to the boring element 20. The spent air from operating the hammer passes from the housing of mole 17 through passage 44 and passages 33 and supporting member 31, passed check valve 36 and out through the exhaust ports or passages 21.

Figure 7:
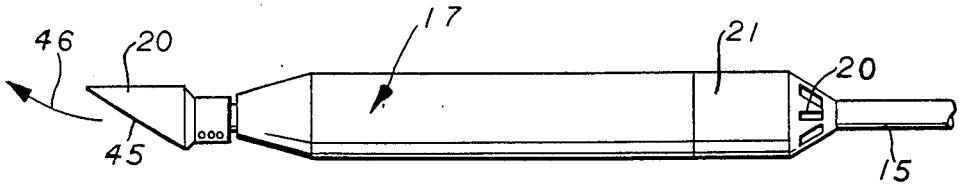
FIGS. 7 and 8 are more detailed schematics of the drilling mole shown in FIGS. 3 and 5, illustrating straight line and curved movement of the tool.
Figure 8:
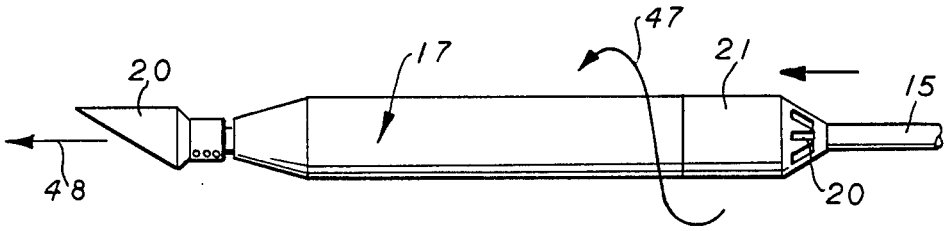
Figure 9:
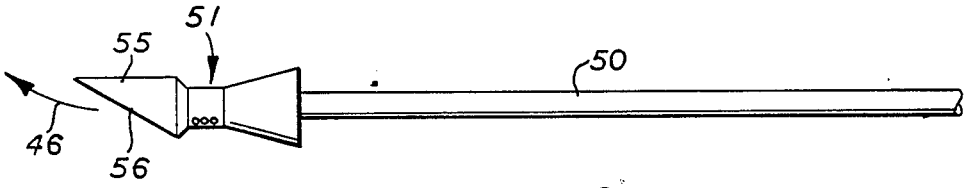
FIGS. 9 and 10 are more detailed schematics of the boring member shown in FIGS. 4 and 6, illustrating straight line and curved movement of the tool.
Figure 10:
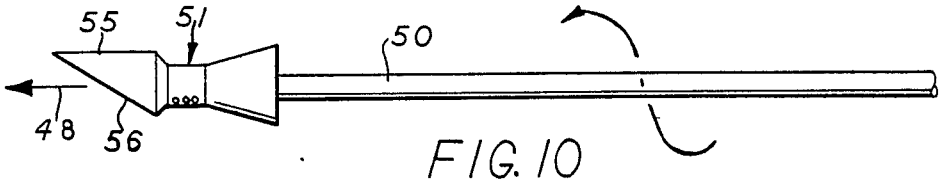

The details shown in FIGS. 7 and 8 show the end of drill pipe or rod 15, drilling mole 17, and boring element 20 in the non-rotating position where the operation of the slanted or inclined face 45 of boring element 20 against the earth will cause the tool to deviate in a curved path as shown by the directional arrow 46. In FIG. 8, the apparatus is shown as being rotated as indicated by arrow 47 and moved by linear or longitudinal movement of pipe 15. This causes the tool to bore in a straight line as indicated by directional arrow 48.

OPERATION

While the operation of this tool and associated apparatus should be apparent from the forgoing description of its construction and assembly, in a further description of operation will be given to facilitate a more thorough understanding of the invention.

Under action of compressed air from the source shown schematically as 19, the hammer in the drilling mole moves toward the front of the body of the mole and impacts on the interior surface of the drilling anvil. Details of this structure can be found in copending application Ser. No. 720,582.

In this position, compressed air is admitted through the connection sub 21 into the interior of the mole first to move the hammer to impact on the anvil and then to move the hammer away from the anvil. The repeated action of the hammer on the anvil causes a percussive impact to be imparted to boring element 20 which pierces the earth without producing cuttings or spoils. The inclined face 45 of boring element 20 is operable to cause the tool to deviate from a straight path.

As previously noted, the tool is advanced into the bore hole by pressure from the drill rig R which is moved along track 14 by motor 23 or other suitable motor means. For example, pneumatic or hydraulic means can be used, if desired, for advancing the rig along the supporting track. The control handle 16 on the rig console 24 selectively control both the thrust to the drill rod, and the rotation of the drill rod which determines whether the hole is drilled in a straight line movement or along an arcuate path.

As drill rod 15 and mole 17 are advanced into the hole, when the drill rig approaches the surface of the earth, in the case of a surface mounted rig, or the edge of the launching pit P, as in the case of the system shown in FIG. 2, additional drill rod or pipe can be added and the rig console retracted to the position away from the entrance to the drill hole and again advanced toward the hole to provide the forward going pressure on the rod for piercing the earth. This apparatus has the advantage over drill moles which are supplied with compressed air through flexible air lines that if the mole becomes disabled underground, it is possible to positively retract the drill mole on the supporting rod and thus avoid the necessity of excavating to locate a mole which has become disabled.

ANOTHER EMBODIMENT

Figure 4:
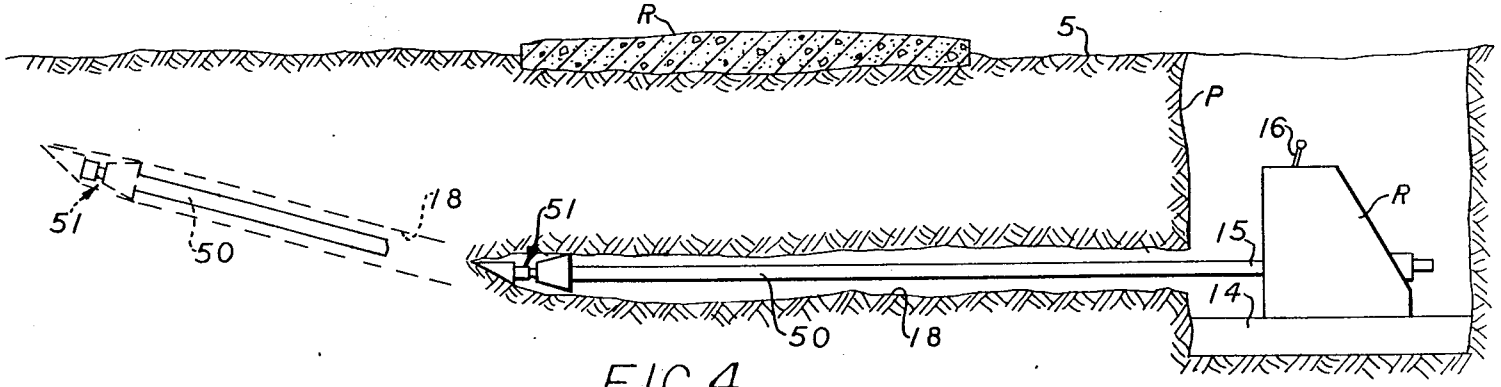
FIG. 4 is a schematic drawing, partially in section, showing horizontal boring from a recessed pit containing a drilling rig, using a boring member mounted on a solid or hollow drill rod and driven by the rig.

In FIG. 4, there is shown a schematic of an alternate embodiment of the invention in which a boring head is supported on a solid or hollow drill rod and moved by a drill rig to penetrate the earth without the use of a boring mole. In FIG. 4 drilling rig R is supported on track 14 as in embodiment shown in FIG. 3. Drilling rig R is controlled handle 16 on the rig console which controls the application of force for moving rig R forward along track 14 or for rotating solid or hollow drill rod 50 which supports boring element 51.

Boring element 51 is pushed by rig R through the soil to produce bore hole 18 under a surface obstruction such as roadway R. Boring element 51 includes a member structured to cause the hole to follow a curved path so long as rod 50 is not rotated. In other words, as long as drilling rig R is pushing rod 50 and drilling element 51 into the soil to produce hole 18, and rod 50 is not rotated, the bore hole 18 will follow a curved path. As will be noted below, when drilling rig R is operated to rotate drill rod 18 and bore head 51, the bore hole 18 continues in a straight direction. The curved or deviated path of bore head 51 when rod 50 is not rotated is shown in dotted line in FIG. 4.

Figure 12:
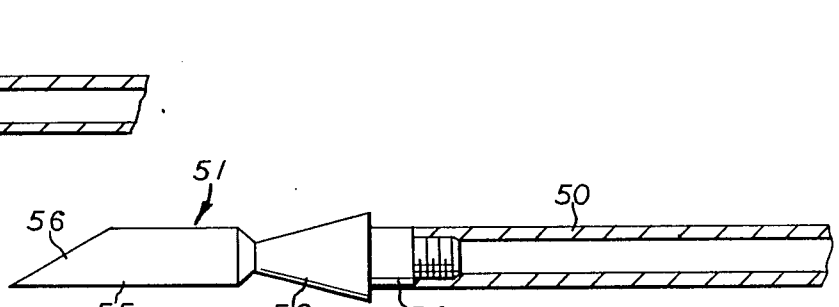
FIG. 12 is a view, partially in section, of the boring member shown in FIG. 11 with an angled nose boring element.
Figure 11:
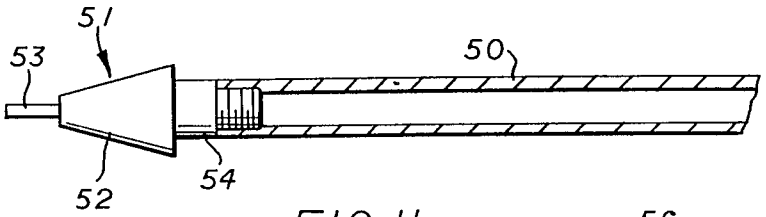
FIG. 11 is a view, partially in section, of one embodiment of the boring member shown in FIGS. 4 and 6.

In FIGS. 11 and 12 there are shown two embodiments of bore head 51 which are used in this embodiment of the invention. In FIG. 11, bore head 51 is supported on drill rod 50 which may be solid rod or a hollow rod or tubing. Boring element 51 comprises a tapered boring element 52 having a small extension 53 which pushes ahead of a boring element and forms a pilot hole leading the conical portion which functions as an expander to enlarge the pilot hole to the size of the base of the cone. At the base of boring element 52 there is a smaller tubular extension 54 which fits inside the end of drill string 50. Tapered boring element 52 may have any suitable taper, e.g. spherical, conical, pyramidal, frustoconical, frustopyramidal, etc.

In FIG. 12, the apparatus shown is the same as that of FIG. 11 except that a boring element 55 has been added. Boring element 55 has a cylindrical body portion with a cylindrical recess (not shown) which fits over tubular extension 53. Boring element 55 has the inclined plane or slanted flat surface 56 which provides a sharp pointed end for penetrating the earth and provides a reaction surface against the earth for causing the tool to deviate in a curve path as the drill rod 50 is advanced longitudinally into the earth.

Figure 6:
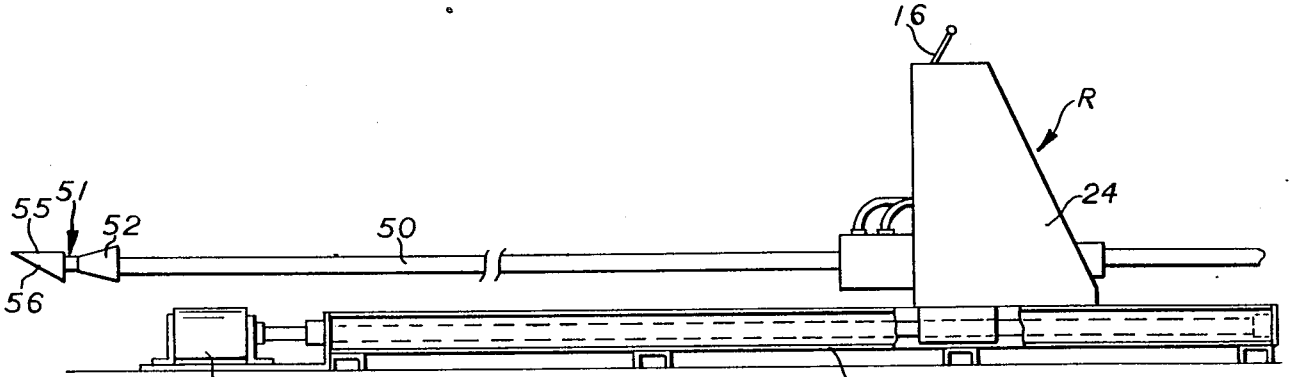
FIG. 6 is a more detailed schematic of the drill rig and boring member shown in FIG. 4.

In FIG. 6, the apparatus shown is essentially that of FIG. 5 but using the drill rod and expanders yet shown in FIGS. 11 and 12. The apparatus of FIG. 6 shows that drill rig R comprises console 24 which rides on track 14 and is driven by motor 23. Motor 23 may be replaced by any other suitable motor means including pneumatic or hydraulic means for moving and actuating the rig console. Motor 23 is effective to move rig console 24 along track 14 to press drill rod 50 into the earth to form the desired bore hole 18. Drill rig R is arranged so that drill rod 50 can be added in sections as the rod is advanced into the hole. In this version, there is no supply of compressed air since the hole is made by mechanically forcing rod 50 and boring head 51 into the earth.

Figure 14A:
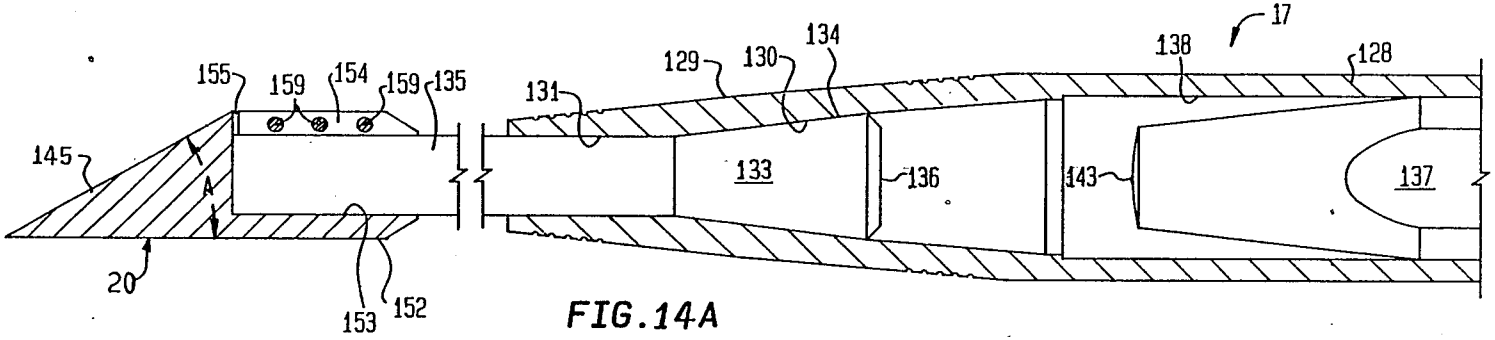
FIGS. 14A and 14B are longitudinal sections of the front and rear portions of the drilling mole.
Figure 14B:
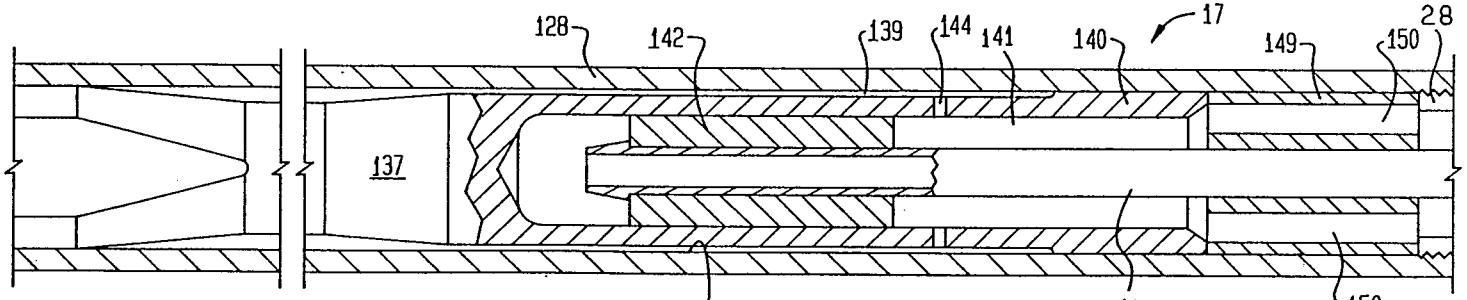

FIGS. 14A and 14B are longitudinal sections on the boring mole 17 shown in FIGS. 3, 5, 7 and 8. As shown, boring mole 17 comprises an elongated hollow cylindrical outer housing or body 128. The outer front end of the body 128 tapers inwardly forming a conical portion 129. The internal diameter of body 128 tapers inwardly near the front end forming a conical surface 130 which terminates in a reduced diameter 131 extending longitudinally inward from the front end. The rear end of the body 128 has internal threads for receiving connection sub 21.

An anvil 133 having a conical back portion 134 and an elongated cylindrical front portion 135 is positioned in the front end of body 128. Conical back portion 134 of anvil 133 forms an interference fit on conical surface 130 of body 128, and the elongated cylindrical portion 135 extends outwardly a predetermined distance beyond the front end of the body. A flat transverse surface 136 at the back end of anvil 133 receives the impact of a reciprocating hammer 137.

Reciprocating hammer 137 is an elongated cylindrical member slidably received within the cylindrical recess 138 of body 128. A substantial portion of the outer diameter of hammer 128 is smaller in diameter than recess 138 in body 128, forming an annular cavity 139 therebetween. A relatively shorter portion 140 at the back end of the hammer 137 is of larger diameter to provide a sliding fit against the interior wall of recess 138 of the body 128.

A central cavity 141 extends longitudinally inward from the back end of hammer 137. A cylindrical bushing 142 is slidably disposed within hammer cavity 141. The front surface 143 of the front end of hammer 137 is shaped to provide an impact centrally on the flat surface 136 of anvil 133. As described hereinafter, the hammer configuration may also be adapted to deliver an eccentric impact force on the anvil.

Air passages 144 in the sidewall of hammer 137 inwardly adjacent the shorter rear portion 140 connect central cavity 141 with annular cavity 139. An air distribution tube 41 extends centrally through bushing 142 and has its back end connected through connectrion sub 21 to supporting pipe 15. For reciprocating hammer 137, air distribution tube 41 is in permanent communication with a compressed air source through connection sub 21 and supporting pipe 15. The arrangement of passages 144 and bushing 142 is such that, during reciprocation of hammer 137, air distribution tube 41 alternately connects annular cavity 139 with the central cavity 141 or atmosphere alternately.

A cylindrical stop member 149 is secured within recess 138 in the body 128 near the back end and has a series of longitudinally-extending, circumferentially-spaced passageways 150 for exhausting the interior of the body 28 to atmosphere through connection sub 21 and a central passage through which the air distribution tube 41 extends.

A slant-end nose member 20 has a cylindrically recessed portion 152 with a central cylindrical bore 153 therein which is received on the cylindrical portion 135 of the anvil 133 (FIG. 14A). A slot 154 through the sidewall of the cylindrical portion 118 extends longitudinally substantially the length of the central bore 153 and a transverse slot extends radially from the bore 153 to the outer circumference of the cylindrical portion, providing flexibility to the cylindrical portion for clamping the nose member to the anvil. A flat 156 is provided on one side of cylindrical portion 118 and longitudinally spaced holes 157 are drilled therethrough in alignment with threaded bores 158 on the other side. Screws 159 are received in the holes 157 and bores 158 and tightened to secure the nose member 20 to the anvil 133.

The sidewall of the nose member 20 extends forward from the cylindrical portion 152 and one side is milled to form a flat inclined surface 45 which tapers to a point at the extended end. The length and degree of inclination may vary depending upon the particular application.

Slanted nose members 20 of $2\frac{1}{2}''$ and $3\frac{1}{2}''$ diameter with angles from 10° to 40° (as indicated by angle "A") have been tested and show the nose member to be highly effective in turning the tool with a minimum turning radius of 28 feet being achieved with a $3\frac{1}{2}$ inch 15 degree nose member.

Testing also demonstrated that the turning effect of the nose member was highly repeatable with deviations among tests of any nose member seldom varying by more than a few inches in 35 feet of bore. Additionally, the slanted nose members were shown to have no adverse effect on penetration rate and in some cases, actually increased it.

It has also been found that the turning radius varies linearly with the angle of inclination. For a given nose angle, the turning radius will decrease in direct proportion to an increase in area.

Figure 15:
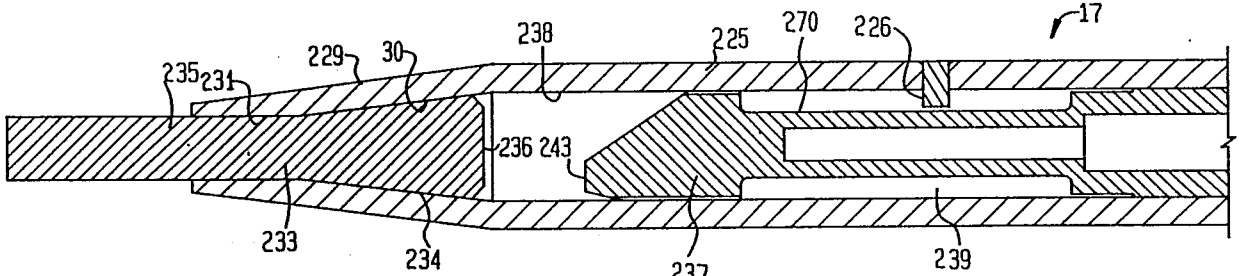
FIG. 15 is a lonfitudinal section of the front protion of a drilling mole having an eccentric hammer.

FIG. 15 is longitudinal cross sections of a portion of a boring tool including an eccentric hammer arrangement. When the center of mass of the hammer is allowed to strike the inner anvil at a point radially offset from the longitudinal axis of the tool, a deflective side force results. This force causes the boring tool to deviate in the direction opposite to the impact point. The only internal modification required is the replacement of the existing hammer.

FIG. 15 shows the front portion details of a boring tool 17 with an eccentric hammer 237. The rear portion of the hammer 237 is not shown since it is the same as the concentric hammer 137 shown in FIG. 14B.

Referring now to FIG. 15, the boring tool 17 comprises an elongated hollow cylindrical outer housing or body 225. The outer front end of the body 225 tapers inwardly forming a conical portion 229. The internal diameter of the body 17 tapers inwardly near the front end forming a conical surface 230 which terminates in a reduced diameter 231 extending longitudinally inward from the front end. The rear end of the body is provided with internal threads for receiving a tail fin assembly previously described.

An anvil 233 having a conical back portion 234 and an elongated cylindrical front portion 235 is contained within the front end of the body 17. The conical back portion 234 of the anvil 233 forms and interference fit on the conical surface 230 of the body 17, and the elongated cylindrical portion 235 extends outwardly a distance beyond the front end of the body. A flat surface 236 at the back end of the anvil 233 receives the impact of the eccentric reciprocating hammer 237.

The eccentric hammer 237 is an elongated cylindrical member slidably received within the internal diameter 238 of the body 17. A substantial portion of the outer diameter of the hammer 237 is smaller in diameter than the internal diameter 238 of the body, forming an annular cavity 39 therebetween. The front portion 243 of the hammer is constructed in a manner to offset the center of gravity of the hammer with respect to its longitudinal axis.

The side wall of the hammer has a longitudinal slot 270 which places the center of mass eccentric to the longitudinal axis and the front surface 243 of the front end of the hammer 237 is shaped to impact centrally on the flat surface 236 of the anvil 233. In order to assure proper orientation of the hammer, a key or pin 226 is secured through the side wall of the body 17 to extend radially inward and be received within the slot 270 to maintain the larger mass of the hammer on one side of the longitudinal axis of the tool.

Under action of compressed air in the central cavity, the hammer moves toward the front of the body 17. When in its foremost position, the hammer imparts an impact on the flat surface of the anvil. In this position, compressed air is admitted. Since the effective area of the hammer including the larger diameter rear portion is greater than the effective area of the central cavity, the hammer starts moving in the opposite direction. During this movement, the bushing closes the passages, thereby interrupting the admission of compressed air into the annular cavity.

The hammer continues its movement due to the expansion of the air until the air passages are displaced beyond the ends of the bushing, and the annular cavity is open to atmosphere. In this position, the air is exhausted from the annular cavity through the air passages now above the trailing edge of the bushing and the holes in the stop member. Then the cycle is repeated.

The eccentric hammer can be used for straight boring by averaging the deflective side force over 360° by rotating the outer body be means of the supporting pipe 15. When the supporting pipe 15 is held to keep the tool housing from rotating, the tool will turn under the influence of the asymmetric boring forces. Either an eccentric hammer or anvil will produce the desired result, since the only requirement is that the axis of the impact does not pass through the frontal center of pressure.

OPERATION

While the operation of this embodiment of the tool and associated apparatus should be apparent from the forgoing description of its construction and assembly, in a further description of operation will be given to facilitate a more thorough understanding of the invention.

As previously noted, the tool is advanced into the bore hole by pressure from the drill rig R which is moved along track 14 by motor 23 or other suitable motor means. For example, pneumatic or hydraulic means can be used, if desired, for advancing the rig along the supporting track. The control handle 16 on the rig console 24 selectively control both the advancing of the rig along the track, which supplies a forward thrust to the drill rod, and the rotation of the drill rod which determines whether the hole is drilled in a straight line movement or along an arcuate path.

This apparatus differs from that of the first embodiment in that the drill rig forces the rod and boring head into the earth and there is no mechanical mole or other boring means for producing the bore hole. The bore hole is formed by straight thrust of the boring element into the soil. The slanted face of boring element 56 will cause the boring head to deviate in a curved path along the line of directional arrow 46 as previously described for FIGS. 7 and 8. This occurs when drill rod 50 is not rotated but is merely pressed into the soil. When drill rod 50 and boring element 51 are rotated by drill rig R the rotation of the inclined face 56 will cause the tool to proceed in a tightly helical path which is essentially a straight line as indicated by directional arrow 48.

This apparatus has the advantage of being operated without the use of a powered mole which is exposed to the possibility of being trapped underground and having to be excavated. In this embodiment of the invention, the boring head 51 is pressed by drilling rig R to penetrate or pierce the ground and to be enlarged to full size of the hole by the conical surface of the boring element. This is all accomplished by the force exerted by drilling rig R from outside the hole.

As drill rod 15 and mole 17 are advanced into the hole, when the drill rig approaches the surface of the earth, in the case of a surface-mounted rig, or the edge of the launching pit P, as in the case of the system shown in FIG. 2, additional drill rod or pipe can be added and the rig console retracted to the position away from the entrance to the drill hole and again advanced toward the hole to provide the forward going pressure on the rod for piercing the earth. This apparatus has the advantage over drill moles which are supplied with compressed air through flexible air lines that if the mole becomes disabled underground, it is possible to positively retract the drill mole on the supporting rod and thus avoid the necessity of excavating to locate a mole which has become disabled.

It should be noted that both embodiments of the invention have been shown as operating from a launching pit P. These embodiments will function in the same manner on the surface for boring an inclined hole as shown in FIG. 2, by merely mounting the drilling rig on a supporting base at the appropriate angle of entry of the bore head into the earth. Whether the hole is pressed in on the end of a rod as in FIGS. 4, 6, 9 and 10 or uses a drilling mole as in the case of FIGS. 3, 5, 7, 8 and 13, the apparatus will function in the same manner when operated from the surface to bore a hole for utilities in a substantially horizontal direction.

While this invention has been described fully and completely with special emphasis upon two preferred embodiments of the invention it should be understood that within the scope of the appended claims the invention may be practiced otherwise than as specifically described above.

We claim:

1. A controllable tool for drilling holes in the earth comprising a hollow elongated rigid supporting drill pipe having a forward end for entering the earth, means supporting said drill pipe for earth boring or piercing movement, including means for moving said drill pipe longitudinally for penetrating the earth, said drill pipe moving means being constructed to permit addition and removal of supporting drill pipe during earth penetrating operation, a boring mole supported on the forward end of said hollow low drill pipe comprising a cylindrical housing supported on and open to the forward end of said drill pipe, a first means on said front end for applying a boring force to the soil comprising an anvil having a striking surface inside said housing and a boring surface outside said housing, a second means comprising a reciprocally movable hammer positioned in said housing to apply a percussive force to said anvil striking surface for transmitting a percussive force to said boring force applying means, and means permitting introduction of air pressure supplied through said hollow pipe into said housing for operating said hammer and for discharging spent air from said housing to the hole being bored, and said tool being operable to penetrate the earth upon longitudinal movement of said drill rod by said longitudinal rod moving means and operation of said mole by reciprocal movement of said hammer.

2. A controllable tool for drilling holes in soft earth comprising an elongated rigid supporting drill rod or pipe, means supporting said drill rod for earth boring or piercing movement, including means for moving said drill rod longitudinally for penetrating the earth means for rotating said drill rod or pipe while penetrating the earth, and means for controlling the direction of movement of said drill rod or pipe along a straight or curved path, said drill rod or pipe moving and rotating means being constructed to permit addition and removal of supporting drill rod or pipe during earth penetrating operation, a boring member comprising an expander having a base end supported on and larger in diameter than said rod or pipe and tapering longitudinally forward therefrom to a cylindrical extension extending a short distance forward, and said tool being operable to penetrate the earth upon longitudinal movement of said drill rod or pipe by said longitudinal rod or pipe moving means.

3. A controllable earth drilling tool according to claim 2 in which said direction controlling means comprises means causing drill rod or pipe movement in a curved path through the earth when said rod or pipe is not rotated and causing drill rod or pipe straight line movement when said rod or pipe is rotated.

4. A controllable earth drilling tool according to claim 1 including means for effecting a controlled rotation of said mole to control the direction of movement of said drill pipe and mole along a straight or curved path.

5. A controllable earth drilling tool according to claim 3 in which said means for causing said drill rod or pipe to have a straight line or curved path of movement comprises a smooth cylindrical member supported on said cylindrical extension and having an inclined plane as a forwardly extending face penetrating the earth on forward movement and operable to control the path of movement by reaction against the earth through which the tool is moved.

6. A controllable earth drilling tool according to claim 5 in which said drill rod or pipe rotating means is operable to rotate said drill rod or pipe to rotate said inclined plane face in the earth to permit said tool to penetrate the earth in a straight line movement when moved longitudinally by said drill rod or pipe moving means.

7. A controllable earth drilling tool according to claim 6 in which said tool is adapted to be operated from a pit or hole in the earth to drive said drill rod or pipe longitudinally therefrom and is adapted to be driven by a surface supported drill rig.

8. A controllable earth drilling tool according to claim 2 in which said drill rod or pipe moving means comprises motor means adapted to be supported in a pit or hole in the earth on a longitudinally extending track and movable along said track.

9. A controllable tool for drilling holes in the earth comprising a hollow elongated rigid supporting drill pipe having a forward end for entering the earth, means supporting said drill pipe for earth boring or piercing movement, means for moving said drill pipe longitudinally for penetrating the earth, a boring mole supported on said hollow drill pipe comprising a cylindrical housing supported on and open to the forward end of said drill pipe, said housing having a front end with means for applying a boring force to the soil comprising an anvil having a striking surface inside said housing and a boring surface outside said housing, a second means comprising a reciprocally movable hammer positioned in said housing to apply a percussive force to said anvil striking surface for transmitting a percussive force to said boring force applying means, said anvil and hammer being configured to apply an asymmetric boring force to cause said tool to deviate in a curved path when moved through the earth with said housing in a non-rotating condition, means for effecting a controlled rotation of said mole to control the direction of movement of said drill pipe and mole along a straight or curved path, and means permitting introduction of air pressure supplied through said hollow pipe into said housing for operating said hammer and for discharging spent air from said housing to the hole being bored, and said tool being operable to penetrate the earth upon longitudinal movement of said drill pipe by said longitudinal pipe moving means and operation of said mole by reciprocal movement of said hammer.

10. A controllable earth drilling tool according to claim 9 including means for rotating said drill pipe while penetrating the earth, and said drill pipe rotating means being selectively operable to rotate said drill pipe and said housing to cause straight line drill pipe movement when said drill pipe is rotated and a curved path drill pipe movement through the earth when said drill pipe is not rotated.

11. A controllable earth drilling tool according to claim 10 in which said means for introducing air into said housing comprises a connecting sub on said housing for connecting the same to said hollow drill pipe and having openings for introducing compressed air from said drill pipe into said housing and for exhausting air used in operating said hammer from said housing through said sub into the hole being bored.

12. A controllable earth drilling tool according to claim 10 in which said cylindrical housing has a tapered front end, said first means on said front end for applying a boring force to the soil comprises an anvil having a striking surface inside said housing and a boring surface outside said housing comprising a cylindrical nose portion having a side face extending longitudinally from the tip at an acute angle thereto, said anvil and nose portion being secured in a fixed non-rotatable position in said housing whereby movement of said tool through the soil is deviated from a straight path by reaction of said angled side face against the soil, and said reciprocally movable hammer in applying a percussive force to said anvil striking surface cooperates therewith to transmit a percussive force to provide said asymmetric boring force

13. A controllable earth drilling tool according to claim 12 in which said means for introducing air into said housing comprises a connecting sub on said housing for connecting the same to said hollow drill pipe and having openings for introducing compressed air from said drill pipe into said housing and for exhausting air used in operating said hammer from said housing through said sub into the hole being bored.

14. A controllable earth drilling tool according to claim 13 in which said connecting sub comprises a first hollow tubular member with a larger body portion and reduced diameter threaded extensions connecting the same to said housing and said hollow drill pipe respectively, said tubular member body portion having at least one exhaust opening adjacent to the point of connection to said hollow drill pipe, a second tubular member positioned inside said tubular extension connected to said hollow drill pipe and extending into the other tubular extension to conduct compressed air to operate said hammer, and means supporting said second tubular member inside said first tubular member to define an annulus through which exhaust air may flow to said exhaust opening.

15. A controllable earth drilling tool according to claim 14 in which said connecting sub includes an annular check valve supported on said second tubular member to permit flow of exhaust air from said tool housing and prevent air flow from the borehole into said tool housing.

16. A controllable earth drilling tool according to claim 13 in which said connecting sub comprises a first hollow tubular member with a larger body portion and reduced diameter threaded extensions connecting the same to said housing and said hollow drill pipe respectively, said tubular member body portion having at least one exhaust opening adjacent to the point of connection to said hollow drill pipe, a second tubular member positioned inside said tubular extension connected to said hollow drill pipe and extending into the other tubular extension to conduct compressed air to operate said hammer, an annular bushing, with longitudinally extending passages therethrough, supporting said second tubular member inside said first tubular member to provide a passage through which exhaust air may flow to said exhaust opening, and an annular check valve supported on said second tubular member to permit flow of exhaust air from said tool housing and prevent air flow from the borehole into said tool housing.

17. A method of drilling holes in soft earth comprising providing an elongated rigid supporting drill rod or pipe with a boring member comprising a frustoconical expander having a base end supported on and larger in diameter than said rod or pipe and tapering longitudinally forward therefrom to a cylindrical extension extending a short distance forward, said boring member including means permitting straight line boring movement when in one position and curved line boring movement when in another position, moving said drill rod or pipe longitudinally to penetrate the earth with said boring member, and controlling the direction of movement of said drill rod or pipe from outside the hole being bored by moving said boring member to said one position or said other position.

18. A method of drilling according to claim 17 in which said step of controlling the direction of movement of said drill rod or pipe comprises providing means to cause the same to move in a curved path through the earth when said rod or pipe is not rotated and to cause drill rod or pipe straight line movement when said rod or pipe is rotated, and selectively rotating said drill rod or pipe to control drill rod or pipe movement selectively between a straight path and a curved path.

19. A method of drilling according to claim 18 in which said step of controlling the direction of movement of said drill rod or pipe comprises providing means for causing said drill rod or pipe to have a straight line or curved path of movement comprising a smooth cylindrical member supported on said cylindrical extension and having an inclined plane as a forwardly extending face to control the path of movement by reaction against the earth through which the tool is moved, and rotating said drill rod or pipe from its base end to rotate said inclined plane face to permit said tool to penetrate the earth in a straight line movement when moved longitudinally into the earth.

20. A method of drilling according to claim 19 including the steps of digging a pit or hole in the earth, providing a surface supported drill rig adjacent to said pit or hole, and forcing said tool into the earth from said pit or hole by said surface supported drill rig.

21. A method of drilling according to claim 19 including the steps of forcing said tool into the earth from the surface and moving said tool in a curved path beneath an intervening obstacle and back to the surface beyond such obstacle.

22. A method of drilling holes in the earth comprising providing a hollow elongated rigid supporting drill pipe with a boring member comprising a cylindrical housing, a first means on said front end for applying a boring force to the soil comprising an anvil having a striking surface inside said housing and a boring surface outside said housing, a second means comprising a reciprocally movable hammer positioned in said housing to apply a percussive force to said anvil striking surface for transmitting a percussive force to said boring force applying means, said anvil and hammer being configured to apply an asymmetric boring force to cause said tool to deviate in a curved path when moved through the earth with said housing in a non-rotating condition, said housing being open to receive air pressure supplied through said hollow pipe for operating said hammer, moving said drill pipe longitudinally and supplying compressed air to reciprocate said hammer to penetrate the earth, and selectively rotating said drill pipe while penetrating the earth, to rotate said pipe and said housing to cause straight line drill pipe movement when said pipe is rotated and a curved path drill pipe movement through the earth when said pipe is not rotated.

23. A method of drilling according to claim in 22 which said drill rod or pipe is rotated from its base end to rotate said asymmetric boring force to permit said tool to penetrate the earth in a straight line movement when moved longitudinally into the earth.

24. A method of drilling according to claim 23 in which said cylindrical housing has a tapered front end, said first means on said front end for applying a boring force to the soil comprises an anvil having a striking surface inside said housing and a boring surface outside said housing comprising a cylindrical nose portion having a side face extending longitudinally from the tip at an acut angle thereto, said anvil and nose portion being secured in a fixed non-rotatable position in said housing whereby movement of said tool through the soil is deviated from a straight path by reaction of said angled side face against the soil, including the steps of supplying air pressure through said hollow rod for operating said reciprocally movable hammer to apply a percussive force to said anvil striking surface to transmit a percussive force to said side face to provide said asymmetric boring force, and rotating said drill pipe from its base end to rotate said asymmetric boring force to permit said tool to penetrate the earth in a straight line movement when moved longitudinally into the earth.

25. A method of drilling according to claim 22 including the steps of digging a pit or hole in the earth, providing a surface supported drill rig adjacent to said pit or hole, and forcing said tool into the earth from said pit or hole by said surface support drill rig.

26. A method of drilling according to claim 22 including the steps of forcing said tool into the earth from the surface and moving said tool in a curved path beneath an intervening obstacle and back to the surface beyond such obstacle.

* * * * *